US009924277B2

(12) United States Patent
Kindred

(10) Patent No.: US 9,924,277 B2
(45) Date of Patent: Mar. 20, 2018

(54) HEARING ASSISTANCE DEVICE WITH DYNAMIC COMPUTATIONAL RESOURCE ALLOCATION

(71) Applicant: Starkey Laboratories, Inc., Eden Prairie, MN (US)

(72) Inventor: Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/722,847

(22) Filed: May 27, 2015

(65) Prior Publication Data

US 2016/0353215 A1 Dec. 1, 2016

(51) Int. Cl.
*H04R 25/00* (2006.01)

(52) U.S. Cl.
CPC ..... *H04R 25/505* (2013.01); *H04R 25/305* (2013.01); *H04R 25/554* (2013.01); *H04R 25/453* (2013.01); *H04R 25/552* (2013.01); *H04R 2225/39* (2013.01); *H04R 2225/43* (2013.01); *H04R 2225/61* (2013.01); *H04R 2460/03* (2013.01)

(58) Field of Classification Search
CPC ..... H04R 25/00
USPC ..... 381/315, 320
See application file for complete search history.

(56) References Cited

U.S. PATENT DOCUMENTS

| | | | | |
|---|---|---|---|---|
| 7,092,365 | B1 | 8/2006 | Tackin et al. | |
| 8,571,242 | B2 | 10/2013 | Bachler et al. | |
| 2009/0092269 | A1* | 4/2009 | Nielsen | H04R 25/658 381/313 |
| 2011/0249846 | A1 | 10/2011 | Natarajan | |
| 2011/0268301 | A1* | 11/2011 | Nielsen | G10L 21/02 381/321 |
| 2013/0188796 | A1* | 7/2013 | Kristensen | H04R 25/453 381/60 |
| 2013/0272553 | A1 | 10/2013 | Meier | |

OTHER PUBLICATIONS

"European Application No. 16171648.5, Extended European Search Report dated Oct. 24, 2016", 7 pgs.

* cited by examiner

*Primary Examiner* — Matthew Eason
*Assistant Examiner* — Phan Le
(74) *Attorney, Agent, or Firm* — Schwegman Lundberg & Woessner, P.A.

(57) ABSTRACT

A hearing assistance device for use by a listener includes a microphone, a receiver, and a processing circuit including a plurality of functional modules to process the sounds received by the microphone for producing output sounds to be delivered to the listener using the receiver. The processing circuit detects one or more auditory conditions demanding one or more functional modules of the plurality of functional modules to each performed at a certain level, and dynamically allocates computational resources for the plurality of functional modules based on one or more auditory conditions.

21 Claims, 3 Drawing Sheets

HEARING ASSISTANCE DEVICE WITH DYNAMIC COMPUTATIONAL RESOURCE ALLOCATION

TECHNICAL FIELD

This document relates generally to hearing assistance devices and more particularly to method and apparatus for dynamically allocating computational resources in a hearing assistance device such as a hearing aid.

BACKGROUND

One or more hearing instruments may be worn on one or both sides of a person's head to deliver sounds to the person's ear(s). An example of such hearing instruments includes one or more hearing aids that are used to assist a patient suffering hearing loss by transmitting amplified sounds to one or both ear canals of the patient. Advances in science and technology allow increasing number of features to be included in a hearing aid to provide the patient with more realistic sounds. On the other hand, when the hearing aid is to be worn in and/or around an ear, the patient generally prefers that the hearing aid is minimally visible or invisible and does not interfere with their daily activities. As more and more features are added to a hearing aid without substantially increasing the power consumption of the hearing aid, computational cost for using these features becomes a concern.

SUMMARY

A hearing assistance device for use by a listener includes a microphone, a receiver, and a processing circuit including a plurality of functional modules to process the sounds received by the microphone for producing output sounds to be delivered to the listener using the receiver. The processing circuit detects one or more auditory conditions demanding one or more functional modules of the plurality of functional modules to each perform at a certain level, and dynamically allocates computational resources for the plurality of functional modules based on one or more auditory conditions.

In one embodiment, a hearing assistance device includes a microphone, a receiver, and a processing circuit coupled between the microphone and the receiver. The microphone receives sounds from an environment of the hearing assistance device and produces a microphone signal representative of the sounds. The receiver produces output sounds based on an output signal and transmits the output sounds to a listener. The processing circuit produces the output signal by processing the microphone signal, and includes a plurality of functional modules, an auditory condition detector, and a computational resource allocator. The auditory condition detector detects one or more auditory condition values indicative of one or more auditory conditions. The one or more auditory conditions are each related to an amount of computation needed by one or more functional modules of the plurality of functional modules to each perform at an acceptable level. The computational resource allocator configured to dynamically adjust one or more calculation rates each associated with a functional module of the plurality of functional modules based on the one or more auditory condition values. In this document, the one or more calculation rates are each a frequency of execution of a set of calculations. In other words, a "calculation rate" specifies how often a particular set of calculations is executed.

In one embodiment, a method for operating a hearing assistance device is provided. The hearing assistance device has a processing circuit including a plurality of functional modules. The method includes detecting one or more auditory condition values indicative of auditory conditions, dynamically adjusting one or more calculation rates each associated with a functional module of the plurality of functional modules based on the one or more auditory condition values, and processing an input signal to produce an output signal using the processing circuit. The auditory conditions are each related to an amount of computation needed by one or more functional modules of the plurality of functional modules to each perform at an acceptable level.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
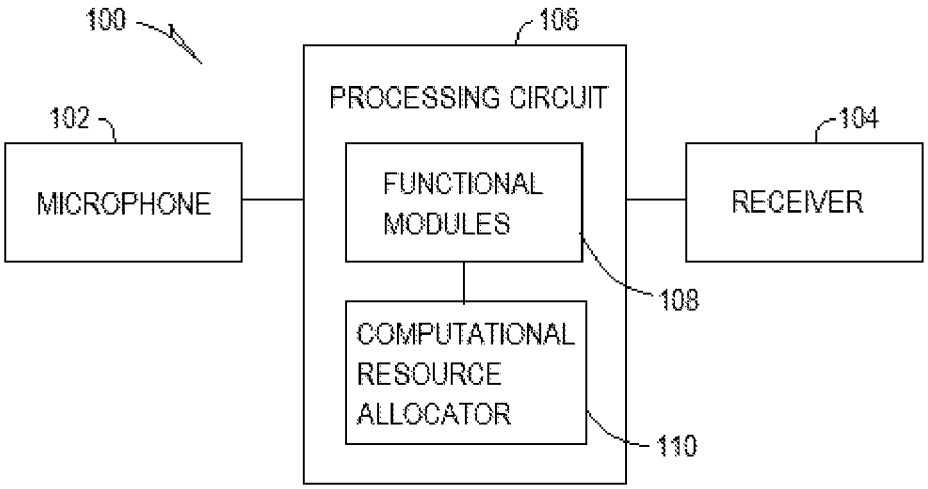
FIG. 1 is a block diagram illustrating an embodiment of a hearing assistance device with computational resource allocation.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present document discusses method and apparatus for dynamically allocating computational resources in a hearing assistance device such as a hearing aid. Million instructions per second (MIPS) and memory size, such as size of random access memory (RAM) and electrically erasable programmable read-only memory (EEPROM), have been limiting constraints in adding features that perform various computations to the hearing assistance device. It is however envisioned that as more functional features are developed and added to the family of functional features already in a hearing aid, the computational burden will increase to a point where power consumption becomes a limiting constraint. It may become necessary to trade computational performance for power in hearing aid design.

The present subject matter manages current consumption of a hearing assistance device such as a hearing aid by letting a functional feature use less power when that functional feature becomes less important in view of the auditory conditions such as auditory environmental conditions. In various embodiments, computational costs of the functional features operating in the hearing assistance device may be continuously re-balanced. At any moment in time, one or more functional features that could benefit from more MIPS would get more MIPS, and one or more other functional features that are not as important at the moment get fewer MIPS. For example, when the environment is quiet, feedback cancellation gets more MIPS while directionality gets fewer MIPS. Conversely, in a louder environment, the directionality gets more MIPS while the feedback cancellation gets fewer MIPS (because with lower gains, the needs for the feedback cancellation are lower).

In one embodiment, such computational resource allocation (or computational cost re-balance) in the hearing assistance device is provided by varying calculation rates of the various functional features of the hearing assistance device. Known examples of hearing assistance devices have a fixed calculation rate for each of its functional features. Functional features that have decreased calculation rates may not perform as well while the calculation rates are higher, but such degradation in performance may be acceptable under certain conditions.

In this document, a "calculation rate" specifies how often a particular set of calculations is executed. For example, a signal processor may apply a gain every sample while updating the gain every fourth sample. The calculation rate for applying the gain is every sample and the calculation rate for updating the value of the gain is every fourth sample.

While varying calculation rates is specifically discussed as an example of varying the computational cost of functional features, the present subject matter is not limited to using the calculation rates, but may use any means for dynamically varying the computational cost and performance of various functional features of a hearing assistance device, such as a hearing aid, depending on the current acoustic environment.

FIG. 1 is a block diagram illustrating an embodiment of a hearing assistance device 100 for use by a listener. Hearing assistance device 100 includes a microphone 102, a receiver (speaker) 104, and a processing circuit 106 coupled between microphone 102 and receiver 104. In one embodiment, hearing assistance device 100 includes a hearing aid to be worn by the listener (hearing aid wearer), who suffers from hearing loss.

Microphone 102 receives sounds from the environment of the listener and produces a microphone signal representative of the sounds. Receiver 104 produces output sounds based on an output signal and transmits the output sounds to the listener. Processing circuit 106 produces the output signal by processing the microphone signal, and includes a plurality of functional modules 108 and a computational resource allocator 110. In various embodiments, functional modules 108 perform various acoustic signal processing techniques for producing the output signal based on the microphone signal, such that the hearing loss of the listener may be compensated by the output sounds when transmitted to one or both ears of the listener. In various embodiments, one or more of functional modules 108 may be customized according to particular hearing loss conditions of the listener. One or more of functional modules 108 may each have such a calculation rate that is dynamically adjustable during the operation of hearing assistance device 100.

Computational resource allocator 110 dynamically allocates computational resources for functional modules 108 based on one or more auditory conditions including various conditions of the listener's environment that may affect performance of the various acoustic signal processing techniques and hence the characteristics of the output sounds. In one embodiment, the one or more auditory conditions include one or more auditory conditions that can be detected from the microphone signal. In one embodiment, computational resource allocator 110 dynamically allocates computational resources by dynamically adjusting one or more calculation rates each associated with a functional module of functional modules 108 based on at least the microphone signal.

Figure 2:
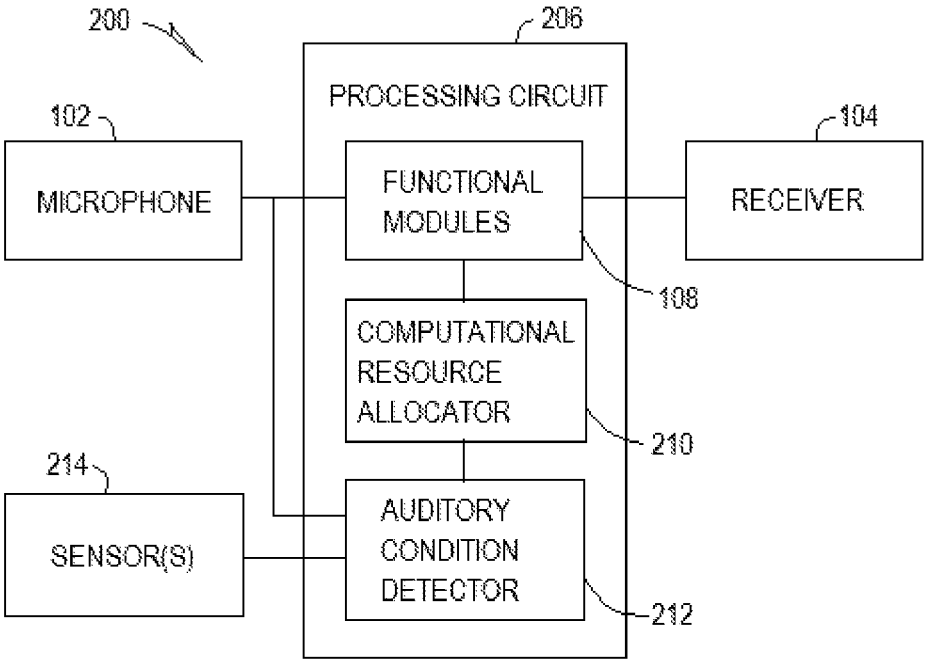
FIG. 2 is a block diagram illustrating another embodiment of the hearing assistance device with computational resource allocation.

FIG. 2 is a block diagram illustrating another embodiment of the hearing assistance device 200 for use by the listener. Hearing assistance device 200 represents an embodiment of hearing assistance device 100 and includes microphone 102, receiver 104, one or more sensors 214, and a processing circuit 206 coupled to microphone 102, receiver 104, and sensor(s) 214.

Sensor(s) 214 sense one or more signals and produce one or more sensor signals representative of the sensed one or more signals. In various embodiments, sensor(s) 214 may include, but are noted limited to, a magnetic field sensor to sense a magnetic field representing a control signal and/or a sound, a telecoil to receive an electromagnetic signal representing sounds, a temperature sensor to sense a temperature of the environment of hearing assistance device 200, an accelerometer or other motion sensor(s) to sense motion of hearing assistance device 200, a gyroscope to measure orientation of hearing assistance device 200, and/or a proximity sensor to sense presence of an object near hearing assistance device 200.

Processing circuit 206 represents an embodiment of processing circuit 106 and produces the output signal by processing the microphone signal. In the illustrated embodiment, processing circuit 206 includes functional modules 108, a computational resource allocator 210, and an auditory condition detector 212. In various embodiments, functional modules 108 may include, but are not limited to a feedback cancellation module, a directionality control module, a spatial perception enhancement module, a speech intelligibility enhancement module, a noise reduction module, an environmental classification module, and/or a binaural processing module.

Auditory condition detector 212 detects one or more auditory condition values indicative of one or more auditory conditions. The one or more auditory conditions are each related to an amount of computation needed by one or more functional modules of functional modules 108 to each perform at an acceptable level. In various embodiments, the acceptable level includes a performance level that meets one or more predetermined criteria. In one embodiment, auditory condition detector 212 detects the one or more auditory condition values indicative of the one or more auditory conditions using the microphone signal. An example of the one or more auditory condition values includes amplitude of the microphone signal, which indicates the level of the sound received by microphone 102. Examples of the one or more auditory condition values also include various attributes of the environment of hearing assistance device 200, including band based attributes such as signal-to-noise ratio and autocorrelation of the microphone signal. In various embodiments, auditory condition detector 212 detects the one or more auditory condition values indicative of the one or more auditory conditions using the microphone signal and/or the one or more sensor signals. Examples of such one or more auditory conditions include presence of a telephone near hearing assistance device 200, proximity of hearing assistance device 200 to a loop system, and proximity of hearing assistance device 200 to other objects such as a hand or a hat.

Computational resource allocator 210 represents an embodiment of computational resource allocator 110 and dynamically allocates computational resources for functional modules 108 based on the one or more auditory condition values detected by auditory condition detector 212. In one embodiment, computational resource allocator 210 dynamically adjusts one or more calculation rates each associated with a functional module of functional modules 108 based on the one or more auditory condition values. In various embodiments, computational resource allocator 210 dynamically adjusts the one or more calculation rates using a predetermined relationship between the one or more auditory condition values and the one or more calculation rates. The relationship between the one or more auditory condition values and the one or more calculation rates can be determined and stored in hearing assistance device 200 as a mapping, a lookup table, or one or more formulas.

Figure 3:
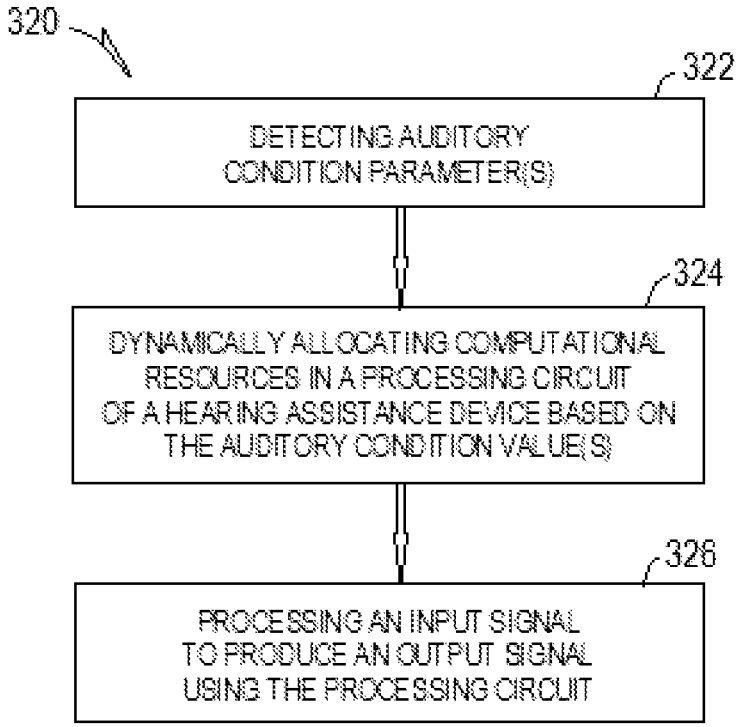
FIG. 3 is a flow chart illustrating an embodiment of a method for dynamically allocating computational resources in a hearing assistance device.

FIG. 3 is a flow chart illustrating an embodiment of a method 320 for dynamically allocating computational resources for a plurality of functional modules in a hearing assistance device that is for use by a listener such as a listener suffering from hearing loss, such as functional modules 108 in hearing assistance devices 100 or 200. In one embodiment, processing circuit 108 or 208 is configured to perform method 320.

At 322, one or more auditory condition values indicative of auditory conditions are detected. The auditory conditions each related to an amount of computation needed by one or more functional modules of the plurality of functional modules to each perform at an acceptable level, such as the level meeting one or more predetermined criteria. In one embodiment, the one or more auditory condition values are detected using the microphone signal produced by a microphone of the hearing assistance device. In another embodiment, the one or more auditory condition values are detected using a signal sensed by a sensor of the hearing assistance device other than the microphone. In various embodiments, the one or more auditory condition values are detected using the microphone and/or one or more sensors of the hearing assistance device other than the microphone.

At 324, computational resources for a processing circuit of the hearing assistance device are dynamically allocated based on the one or more auditory condition values. The processing circuit includes the plurality of functional modules, and the dynamic allocation of the computational resources for the processing circuit includes dynamically allocating computational resources for the plurality of functional modules. In various embodiments, the dynamic computational resource allocation is performed such that each functional module is allowed to use sufficient computational power to perform at the acceptable level. The dynamic computational resource allocation may also be performed such that each functional module is prevented from using computational power that is considered excessive (such as additional computational power that does not improve the quality of the sounds heard by the listener in a substantially noticeable way). The level of performance and the amount of computational power considered excessive may each be measured by one or more quality parameters indicative of quality of the sounds heard by the listener. In one embodiment, the dynamic computational resource allocation is performed by dynamically adjusting one or more calculation rates each associated with a functional module of the plurality of functional modules based on the one or more auditory condition values, such as by using a relationship between the one or more auditory condition values and the one or more calculation rates that is predetermined and stored as a mapping, a lookup table, or one or more formulas in the hearing assistance device.

At 326, an input signal is processed to produce an output signal using the processing circuit. This includes processing the microphone signal to produce the output signal using one or more modules of the plurality of functional modules. The output signal is converted to output sounds to be transmitted to one or both ears of the listener using a receiver of the hearing assistance device.

Figure 4:
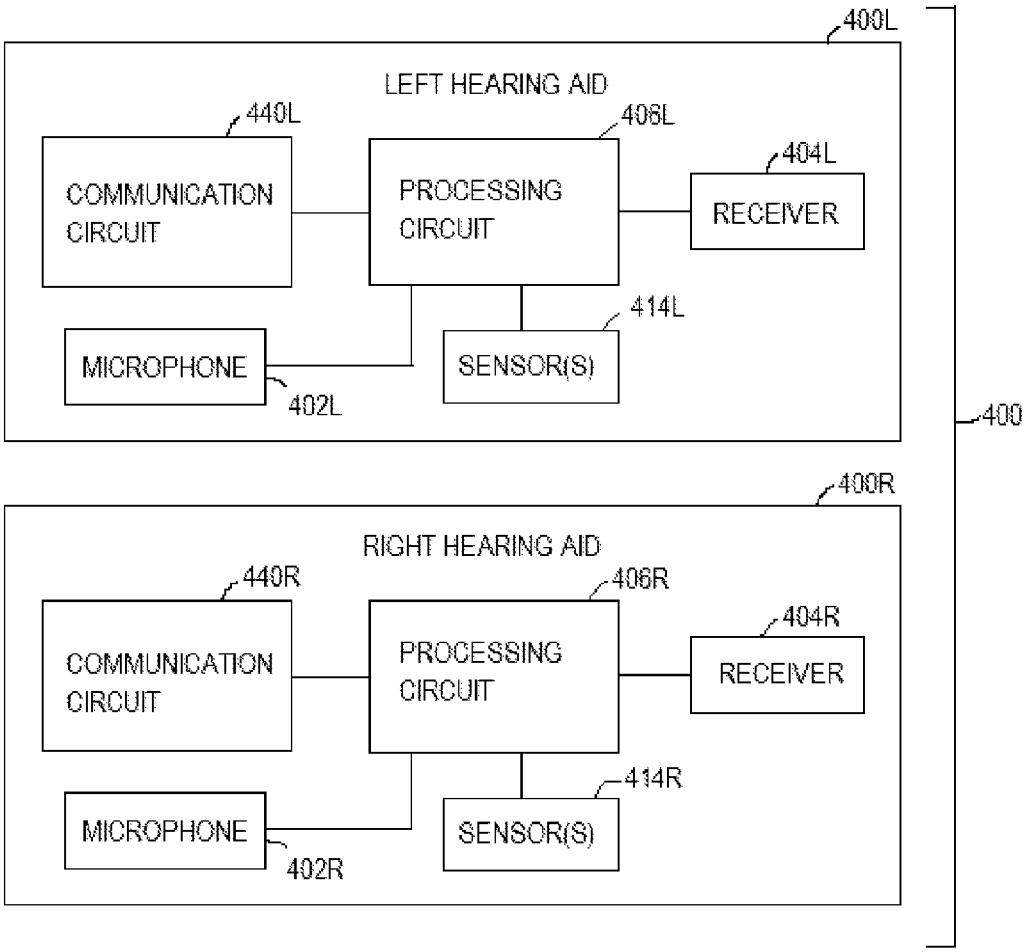
FIG. 4 is a block diagram illustrating an embodiment of a pair of hearing aids.

FIG. 4 is a block diagram illustrating an embodiment of a pair of hearing aids 400, which represents an embodiment of hearing assistance device 200. Hearing aids 400 include a left hearing aid 400L and a right hearing aid 400R. Various embodiments of the present subject matter can be applied to a single hearing aid as well as a pair of hearing aid such as hearing aids 400.

Left hearing aid 400L includes a microphone 402L, a communication circuit 440L, a processing circuit 406L, one or more sensors 414L, and a receiver (speaker) 404L. Microphone 402L receives sounds from the environment of the listener (hearing aid wearer). Communication circuit 440L wirelessly communicates with a host device and/or right hearing aid 400R, including receiving signals from the host device directly or through right hearing aid 400R. Processing circuit 406L processes the sounds received by microphone 402L and/or an audio signal received by communication circuit 440L to produce a left output sound. In various embodiments, one or more signals sensed by sensor(s) 414L are used by processing circuit 406L in the processing of the sounds. Receiver 404L transmits the left output sound to the left ear canal of the listener.

Right hearing aid 400R includes a microphone 402R, a communication circuit 440R, a processing circuit 406R, one or more sensors 414R, and a receiver (speaker) 404R. Microphone 402R receives sounds from the environment of the listener. Communication circuit 440R wirelessly communicates with the host device and/or left hearing aid 400L, including receiving signals from the host device directly or through left hearing aid 400L. Processing circuit 406R processes the sounds received by microphone 402R and/or an audio signal received by communication circuit 440R to produce a right output sound. In various embodiments, one or more signals sensed by sensor(s) 414R are used by processing circuit 406R in the processing of the sounds. Receiver 404R transmits the right output sound to the right ear canal of the listener.

In various embodiments, dynamical computing resource allocation is applied in hearing aids 400. Processing circuits 406L and 406R are each an embodiment of processing circuit 106 and includes functional modules 108 and computing resource allocator 110, or an embodiment of processing circuit 206 and includes functional modules 108 computing resource allocator 210, and auditory condition detector 212. In various embodiments, processing circuits 406L and 406R coordinate their operations with each other, using communicating circuits 440L and 440R, such that the dynamic computational resource allocations as performed in left and right hearing aids 400L and 400R are synchronized. This allows the quality and characteristics of the left and right output sounds to be consistent with each other, thereby providing the listener with listening comfort.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In various embodiments, processing circuits 106, 106, 406L, and 406R as discussed in this document are each implemented using such a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device for use by a listener, comprising:

a microphone configured to receive sounds from an environment of the hearing assistance device and produce a microphone signal representative of the sounds;

a receiver configured to produce output sounds based on an output signal and transmit the output sounds to the listener; and a processing circuit configured to produce the output signal by processing the microphone signal, the processing circuit including:

a plurality of functional modules each configured to execute a set of calculations;

an auditory condition detector configured to detect one or more auditory condition values indicative of one or more auditory conditions each related to an amount of computation needed by one or more functional modules of the plurality of functional modules to each perform at an acceptable level; and a computational resource allocator configured to dynamically adjust one or more calculation rates based on the one or more auditory condition values, the one or more calculation rates each including a frequency at which the set of calculations is executed by a functional module of the plurality of functional modules.

2. The hearing assistance device of claim 1, comprising a hearing aid including the microphone, the receiver, and the processing circuit, and wherein the plurality of functional modules are configured to produce the output signal for compensating for hearing loss of the listener.

3. The hearing assistance device of claim 1, wherein the auditory condition detector is configured to detect the one or more auditory condition values from the microphone signal.

4. The hearing assistance device of claim 3, wherein the auditory condition detector is configured to detect an amplitude of the microphone signal.

5. The hearing assistance device of claim 4, wherein the auditory condition detector is configured to detect a signal-to-noise ratio of the microphone signal.

6. The hearing assistance device of claim 5, wherein the auditory condition detector is configured to detect an auto-correlation of the microphone signal.

7. The hearing assistance device of claim 1, further comprising one or more sensors configured to sense one or more signals and produce one or more sensor signals representative of the sensed one or more signals, and wherein the auditory condition detector is configured to detect the one or more auditory condition values using the one or more sensor signals.

8. The hearing assistance device of claim 7, wherein the one or more sensors comprise one or more of a magnetic field sensor configured to sense a magnetic field, a telecoil configured to receive an electromagnetic signal representing sounds, a temperature sensor configured to sense a temperature, one or more motion sensors configured to sense motion of the hearing assistance device, a gyroscope configured to measure orientation of the hearing assistance device, or a proximity sensor configured to sense presence of an object within proximity of the hearing assistance device.

9. The hearing assistance device of claim 1, wherein the plurality of functional modules comprises one or more of a feedback cancellation module, a directionality control module, a spatial perception enhancement module, a speech intelligibility enhancement module, a noise reduction module, an environmental classification module, or a binaural processing module.

10. The hearing assistance device of claim 1, wherein the computational resource allocator is configured to dynamically adjust the one or more calculation rates using a predetermined relationship between the one or more auditory condition values and the one or more calculation rates.

11. The hearing assistance device of claim 10, wherein the computational resource allocator is configured to store a mapping relating the one or more auditory condition values to the one or more calculation rates in the hearing assistance device and dynamically adjust the one or more calculation rates using the mapping.

12. The hearing assistance device of claim 10, wherein the computational resource allocator is configured to store a lookup table relating the one or more auditory condition values to the one or more calculation rates in the hearing assistance device and dynamically adjust the one or more calculation rates using the lookup table.

13. A method for operating a hearing assistance device having a processing circuit including a plurality of functional modules, the method comprising:

detecting one or more auditory condition values indicative of auditory conditions, the auditory conditions each related to an amount of computation needed by one or more functional modules of the plurality of functional modules to each perform at an acceptable level;

dynamically adjusting one or more calculation rates based on the one or more auditory condition values, the one or more calculation rates each including a frequency at which a set of calculations is executed by a functional module of the plurality of functional modules; and processing an input signal to produce an output signal using the processing circuit.

14. The method of claim 13, wherein processing the input signal to produce the output signal using the processing circuit comprises processing the input signal to produce the output signal using a processor of a hearing aid for compensating for hearing loss of a hearing aid wearer.

15. The method of claim 13, wherein detecting the one or more auditory condition values comprises:

receiving one or more sensor signals from one or more sensors of the hearing assistance device; and detecting the one or more auditory condition values using the one or more sensor signals.

16. The method of claim 15, wherein receiving one or more sensor signals from one or more sensors of the hearing assistance device comprises receiving a microphone signal from a microphone of the hearing assistance device, and detecting the one or more auditory condition values using the one or more sensor signals comprises detecting the one or more auditory condition values using the microphone signal.

17. The method of claim 15, wherein dynamically adjusting the one or more calculation rates comprises dynamically adjusting the one or more calculation rates such that each functional module of the plurality of functional modules is allowed to use sufficient computational power to perform at a level meeting one or more predetermined criteria.

18. The method of claim 17, wherein dynamically adjusting the one or more calculation rates further comprises dynamically adjusting the one or more calculation rates such that each functional module of the plurality of functional modules is prevented from using computational power that is considered excessive.

19. The method of claim 15, wherein dynamically adjusting the one or more calculation rates comprises dynamically adjusting the one or more calculation rates using a predetermined relationship between the one or more auditory condition values and the one or more calculation rates that is stored in the hearing assistance device.

20. The method of claim 19, wherein using the predetermined relationship between the one or more auditory condition values and the one or more calculation rates comprises using a mapping relating the one or more auditory condition values to the one or more calculation rates.

21. The method of claim 19, wherein using the predetermined relationship between the one or more auditory condition values and the one or more calculation rates comprises using a lookup table relating the one or more auditory condition values to the one or more calculation rates.

* * * * *